US007866657B2

(12) United States Patent
Mine et al.

(10) Patent No.: US 7,866,657 B2
(45) Date of Patent: Jan. 11, 2011

(54) PAPER-FEEDING ROLLER

(75) Inventors: Akihiro Mine, Hyogo (JP); Hirokazu Nishimori, Hyogo (JP); Yasuchika Ito, Hyogo (JP); Toshiyuki Hirai, Hyogo (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 489 days.

(21) Appl. No.: 11/092,600

(22) Filed: Mar. 29, 2005

(65) Prior Publication Data

US 2005/0218582 A1 Oct. 6, 2005

(30) Foreign Application Priority Data

Mar. 30, 2004 (JP) ..... 2004-101591

(51) Int. Cl.
*B65H 3/06* (2006.01)
*B25F 5/02* (2006.01)
*F16C 13/00* (2006.01)

(52) U.S. Cl. ..... 271/109; 492/56

(58) Field of Classification Search ..... 271/109, 271/264, 275, 314, 18; 492/30, 31, 48, 50, 492/53, 56, 59; 198/780, 843, 699.1, 699
See application file for complete search history.

(56) References Cited

U.S. PATENT DOCUMENTS 4,192,497 A * 3/1980 Perun et al. ..... 271/18
4,766,996 A * 8/1988 Gibson ..... 198/780
5,376,448 A * 12/1994 Suzuki et al. ..... 428/382
5,790,926 A * 8/1998 Mizoe et al. ..... 399/174
5,805,961 A * 9/1998 Mizoe et al. ..... 399/174
6,547,461 B1 * 4/2003 Matsuda et al. ..... 396/614
6,696,211 B2 * 2/2004 Yoshida et al. ..... 430/108.3
7,043,175 B2 * 5/2006 Komoto et al. ..... 399/159
2001/0004667 A1 * 6/2001 Okubo et al. ..... 534/692
2002/0009661 A1 * 1/2002 Hashimoto et al. ..... 430/106.1
2002/0044804 A1 * 4/2002 Kimura et al. ..... 399/325
2003/0099780 A1 * 5/2003 Christ et al. ..... 427/508
2003/0123909 A1 * 7/2003 Akashi et al. ..... 399/286
2003/0162111 A1 * 8/2003 Otani et al. ..... 430/108.4
2004/0065528 A1 * 4/2004 Inoue ..... 198/699.1
2005/0228081 A1 * 10/2005 Uchida et al. ..... 524/2

FOREIGN PATENT DOCUMENTS

JP 2002-145466 A 5/2002

* cited by examiner

*Primary Examiner*—Stefanos Karmis
*Assistant Examiner*—Patrick Cicchino
(74) *Attorney, Agent, or Firm*—Birch, Stewart, Kolasch & Birch, LLP

(57) ABSTRACT

A paper-feeding roller including a rubber composition containing short fibers in which the short fibers has an average fiber diameter not less than 10 μm nor more than 100 μm and an average fiber length not less than 0.01 mm nor more than 4 mm. At least one part of all of the short fibers is radially oriented at an angle not less than 10 degrees nor more than 90 degrees with respect to a plane which contacts a surface of the paper-feeding roller, with one end of each of the radially oriented short fibers disposed exposably on the surface of the paper-feeding roller.

4 Claims, 5 Drawing Sheets

PAPER-FEEDING ROLLER

This nonprovisional application claims priority under 35 U.S.C. §119(a) on Patent Application No(s). 2004-101591 filed in Japan on Mar. 30, 2004, the entire contents of which are hereby incorporated by reference.

BACKGROUND OF THE INVENTION

1. Field of the Invention

The present invention relates to a paper-feeding roller and more particularly to a paper-feeding roller composed of a rubber composition containing short fibers. The orientation of the short fiber is improved to thereby suppress a variation in the friction coefficient of the surface of the paper-feeding roller.

2. Description of the Related Art

A paper-feeding rubber roller is used for paper-feeding mechanisms such as various types of printers, an electrostatic copying machine, a facsimile apparatus, an automatic teller machine (ATM) and the like. The paper-feeding roller of the present invention means a paper supply roller which transports paper owing to the rotation thereof and the friction between the surface thereof and paper with the paper supply roller in contact with the paper, a resist roller, and a paper-feeding roller and/or a transcribe roller. The coefficient of friction of the surface of the paper-feeding roller is affected adversely by foreign matters which have attached to the surface thereof. For example, a problem occurs that when paper powder attaches to the surface of the paper-feeding roller, the paper is faultily transported.

To overcome the above-described problem, a paper-feeding roller composed of a rubber composition containing a glass fiber is proposed, as disclosed in the patent document 1. A part of the glass fiber is disposed on the surface of the paper-feeding roller to expose the glass fiber partly. The exposed portion of the glass fiber has an effect of scratching the surface of paper. The paper-scratching effect is hardly obstructed by the paper powder that has attached to the surface of the paper-feeding roller, thus making it possible to reduce the degree of faulty transport of paper.

The rubber composition containing the short fiber becomes hard. Consequently the area of contact between the paper-feeding roller and the paper decreases. Thus the coefficient of friction of the surface of the paper-feeding roller tends to become low. However, the paper-feeding roller is capable of sufficiently performing its function when it has a coefficient of friction necessary for transporting the paper and is not demanded to have a higher coefficient of friction.

In recent years, owing to the progress of the color printing technique and a growing demand for forming a high-quality image, in various types of printers, polymerization toner has come to be used instead of conventional toner manufactured by a pulverizing method. The polymerization toner has a small particle size distribution. Even small-diameter particles of the polymerization toner have a high flowability. Thus the polymerization toner allows a high transfer efficiency to be obtained and a high-quality image to be formed. Therefore it is conceivable that high-performance printers using the polymerization toner will be popular in the future.

However, paper is faultily transported in various types of printers in which the polymerization toner is used and a paper-feeding roller composed of the rubber composition containing the glass fiber is mounted.

The main reason for the faulty transport of paper is as follows: The polymerization toner is formed by chemically fusing low-molecular-weight resin, consisting of finely divided particles, formed by emulsion polymerization, a pigment, and paraffin wax together. The resin having a low molecular weight and the wax attach to the rubber roller readily. This indicates that the addition of the glass fiber to the rubber composition is insufficient for preventing the polymerization toner and the wax from attaching to the surface of the rubber roller.

Patent document 1: Japanese Patent Application Laid-Open No. 2002-145466

SUMMARY OF THE INVENTION

The present invention has been made in view of the above-described problems. Therefore it is an object of the present invention to provide a paper-feeding roller capable of preventing polymerization toner and wax from attaching to the surface thereof and favorably maintaining the coefficient of friction of the surface thereof.

To solve the above-described problems, there is provided a paper-feeding roller including a rubber composition containing short fibers in which the short fibers has an average fiber diameter not less than 10 μm nor more than 100 μm and an average fiber length not less than 0.01 mm nor more than 4 mm. At least one part of all of the short fibers is radially oriented at an angle not less than 10 degrees nor more than 90 degrees with respect to a plane which contacts a surface of the paper-feeding roller with one end of each of the radially oriented short fibers disposed exposably on the surface of the paper-feeding roller.

A desired coefficient of friction of the paper-feeding roller of the present invention is generated not on the surface of the rubber thereof, but a part of the short fibers is radially oriented in the above-described angle range, with one end of each of the radially oriented short fibers disposed exposably on the surface of the paper-feeding roller. Owing to the frictional force and the scratching effect of the short fibers, paper is transported and stopped. This construction prevents deterioration of the coefficient of friction of the surface of the paper-feeding roller unlike the conventional paper-feeding roller, even though polymerization toner and wax attach to the surface of the paper-feeding roller. Thereby the paper-feeding roller of the present invention eliminates disadvantages that occur owing to the deterioration of the coefficient of friction.

It is preferable that the rubber composition contains not less than 0.1 nor more than 30 parts by weight of the short fibers per 100 parts by weight of rubber.

It is preferable that the number of the short fibers whose one end is exposably disposed on the surface of the paper-feeding roller is not less than five nor more than 100 per 1 $mm^2$ of the surface of the rubber roller.

It is preferable that an amount of projection of the exposed short fibers from the surface of the paper-feeding roller is 5 μm to 150 μm.

As the short fibers, a carbon fiber or a glass fiber can be suitably used.

It is preferable that not less than 50 parts by weight of 100 parts by weight of the rubber consists of silicone rubber or ethylene-propylene-diene rubber.

In the paper-feeding roller of the present invention, a part of the short fibers is radially oriented, with one end of each of the radially oriented short fibers disposed exposably on the surface of the paper-feeding roller. Thereby the polymerization toner and the wax hardly attach to the surface of the paper-feeding roller. Therefore the short fibers allow the coefficient of friction of the surface of the paper-feeding roller to be maintained favorably for a long time. Even though the polymerization toner and the wax attach to the surface of the paper-feeding roller, the coefficient of friction of the surface of the paper-feeding roller deteriorate to a low degree. Owing to the use of the paper-feeding roller of the present invention, an image-forming apparatus using the polymerization toner is capable of maintaining a favorable paper transport performance for a long time.

DETAILED DESCRIPTION OF THE PREFERRED EMBODIMENTS

The embodiments of the present invention will be described below with reference to drawings.

Figure 1:
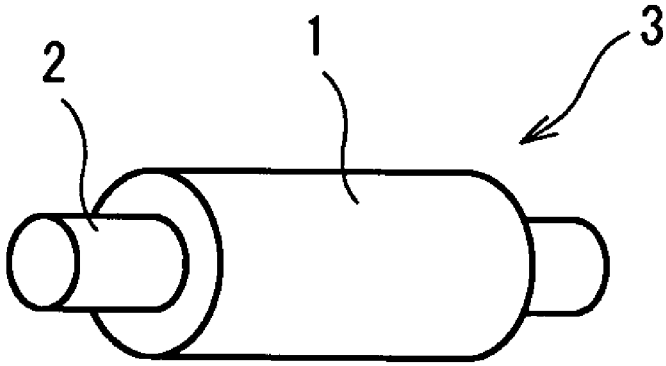
FIG. 1 is a perspective view of a paper-feeding roller 1 of the present invention.

FIG. 1 is a perspective view of a paper-feeding roller 1 of the present invention. A cylindrical core (shaft) 2 is inserted into a hollow portion of the paper-feeding roller 1. Although the thickness of the paper-feeding roller 1 is not limited specifically, the thickness is set to not less than 1 mm nor more than 20 mm in the embodiment. Although the length of the paper-feeding roller 1 is not limited specifically, the length is set to not less than 3 mm nor more than 200 mm in the embodiment.

Figure 2:
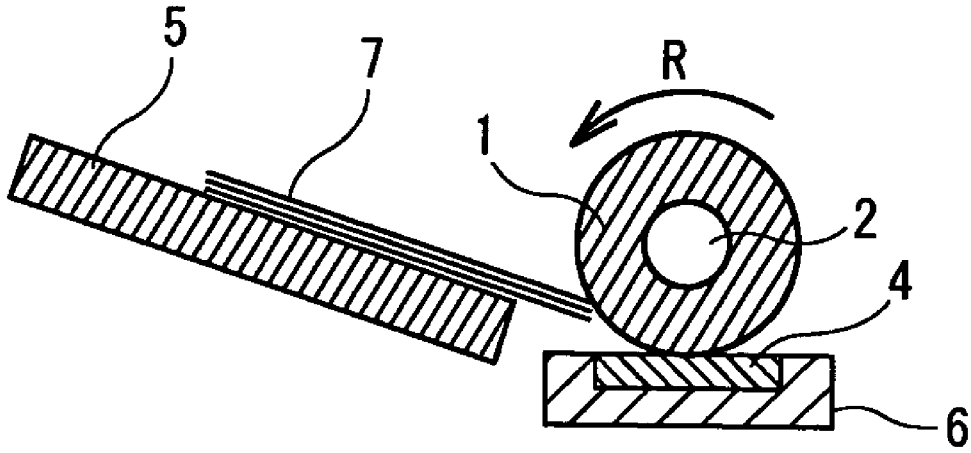
FIG. 2 is an illustrative sectional view showing an example of a paper-feeding mechanism including the paper-feeding roller 1 shown in FIG. 1.

FIG. 2 is an illustrative sectional view showing an example of a paper-feeding mechanism including the paper-feeding roller 1 shown in FIG. 1. The paper-feeding mechanism has a paper-feeding roller 1, a separation pad 4, and a tray 5. The separation pad 4 and the tray 5 are spaced at a certain interval. An upper surface of the separation pad 4 and that of the tray 5 form an angle of elevation. The separation pad 4 is fixed to a substrate 6. The separation pad 4 and the paper-feeding roller 1 are opposed to each other.

Paper 7 in contact with the surface of the paper-feeding roller 1 is transported from the tray 5 one by one in the direction shown by the arrow R of FIG. 1 owing to the rotation of the paper-feeding roller 1.

The paper-feeding roller 1 can be obtained by molding the rubber composition into a desired configuration and vulcanizing it. In addition to rubber and short fibers, the rubber composition contains a proper amount of various additives. As the additive, a crosslinking agent, a filler, a softening agent, a reinforcing agent, a crosslinking assistant agent, a coloring agent, and an antioxidant are used. It is desirable to disperse the short fibers in the rubber composition as uniformly as possible. When the dispersibility of the short fiber is low, it is difficult to uniformly disperse the short fibers on the surface of the rubber roller.

The kind of the rubber is not limited to a specific one. But it is possible to use ethylene-propylene-diene rubber, silicone rubber, urethane rubber, polynorbornane, chlorinated polyethylene, polyisoprene, polybutadiene, natural rubber, SBR, and NBR. These rubbers can be used singly or in combination. Of these rubbers, the ethylene-propylene-diene rubber and the silicone rubber can be preferably used. In the present invention, it is possible to use both an oil-unextended rubber consisting of a rubber component and an oil-extended rubber containing the rubber component and an extended oil.

It is preferable to use the ethylene-propylene-diene rubber to enhance the weatherability and oxidation resistance of the rubber roller. Since the main chain of the ethylene-propylene-diene rubber consists of saturated hydrocarbon and thus includes no double bonds, the ethylene-propylene-diene rubber is less subject to deterioration. Thus the rubber roller containing the ethylene-propylene-diene rubber is less subject to deterioration, even though it is exposed to an ozone atmosphere having a high concentration and to irradiation of light beams for a long time.

It is preferable to use the silicone rubber to prevent slip of paper efficiently. The silicone rubber has oil-absorbing property. Thus even though oil attaches to the surface of the rubber roller, the slip of the paper hardly occurs. In a color copying apparatus, oil is liable to ooze out of a fixing roller composed of the silicone rubber. Therefore the silicone rubber is suitable for the paper-feeding roller for use in the color copying apparatus.

When the ethylene-propylene-diene rubber and other rubbers are used in combination, the ethylene-propylene-diene rubber is used favorably at not less than 50 wt % and more favorably at not less than 80 wt % of the whole rubber component to enhance the weatherability and oxidation resistance of the rubber roll.

The kind of the short fiber to be contained in the rubber composition is not specifically limited. But for example, it is possible to use a carbon fiber and a glass fiber. These fibers can be used singly or in combination.

It is preferable to use the carbon fiber from the standpoint of conductivity. For example, it is possible to use a short fiber obtained by heat-treating polyacrylonitrile, a short fiber obtained by heat-treating a fiber made by spinning petroleum pitch, and carbon nano-tube.

It is preferable to use the glass fiber when conductivity is not desired. For example, it is possible to use a short fiber obtained by drawing out melted glass fibrously at a high temperature and cutting it. As the mode of the glass fiber, it is possible to use a mono-filament and a chopped strand obtained by cutting glass roving consisting of a plurality of arranged threads (strand). It is possible to use aluminosilicate based non-alkali fiber glass and soda lime based glass as the material for the glass fiber. More specifically, it is possible to use E glass, C glass having acid resistance, S glass having a high elasticity, and heat-resistant R glass.

In the present invention, it is favorable that the short fibers has an average fiber diameter not less than 10 μm nor more than 100 μm and an average fiber length not less than 0.01 mm nor more than 4 mm.

If the average fiber diameter of the short fibers is less than 10 μm, the short fibers lack rigidity and in addition the portion of each of the short fibers projected from the surface of the rubber roller deteriorates rapidly. On the other hand, if the average fiber diameter of the short fibers is more than 100 μm, an image on the paper in contact with the rubber roller is liable to be marred by the portions of the short fibers projected from the surface of the rubber roller.

It is more favorable that the short fibers have an average fiber diameter not less than 10 μm nor more than 50 μm.

If the average fiber length is less than 0.01 mm, it is difficult for the short fibers to favorably maintain the coefficient of friction of the surface of the rubber roller for a long time. On the other hand, if the average fiber length of the short fibers is more than 4 mm, it is difficult to obtain a state in which the short fibers are dispersed in the rubber composition favorably.

It is more favorable that the average fiber length of the short fibers is not less than 1 mm nor more than 3 mm.

It is preferable that an amount of projection of the exposed short fibers from the surface of the paper-feeding roller is 10 μm to 100 μm.

It is favorable that the rubber composition contains not less than one nor more than 20 parts by weight of the short fibers per 100 parts by weight of rubber.

If the amount of the short fibers is less than one part by weight per 100 parts by weight of the rubber, it is difficult for the short fibers to obtain an action of sufficiently preventing polymerization toner, wax, and the like from attaching to the surface of the rubber roller. On the other hand, if the amount of the short fiber is more than 20 parts by weight per 100 parts by weight of the rubber, the rubber roller becomes too hard. Thereby a preferable coefficient of friction cannot be realized. It is more favorable that the rubber composition contains not less than two nor more than 15 parts by weight of the short fibers per 100 parts by weight of the rubber.

As crosslinking agents to be contained in the rubber composition, it is possible to use organic peroxides, inorganic peroxides, sulfur, and metal peroxides. It is preferable to select the kind of the crosslinking agent according to the kind of rubber. For example, when the ethylene-propylene-diene rubber or the silicone rubber is used, the organic peroxides can be suitably used as the crosslinking agent.

As the organic peroxides, the following substances are preferable: dicumyl peroxide (DCP), 1,3-bis(t-butyl peroxyisopropyl)benzene, 1,4-bis(t-butyl peroxyisopropyl) 3,3,5-trimethylcyclohexane, 2,5-dimethyl-2,5-di-(t-butyl peroxy) hexyne, n-butyl-4,4-bis(t-butyl peroxy)valerate, and 2,5-dimethyl-2,5-bis(t-butyl peroxy)hexane. These peroxides can be used singly or in combination.

When the ethylene-propylene-diene rubber is crosslinked, the dicumyl peroxide can be preferably used because it has a high crosslinking efficiency. When the silicone rubber is crosslinked, 2,5-dimethyl-2,5-bis(t-butyl peroxy)hexane can be preferably used.

As the filler to be contained in the rubber composition, it is possible to use inorganic fillers such as calcium carbonate, titanium oxide, magnesium carbonate; ceramic powder; and wood powder. The addition of the filler to the rubber composition improves the mechanical strength of the rubber roller. It is preferable to add not more than 100 parts by weight of the filler to 100 parts by weight of rubber.

As the softening agent to be contained in the rubber composition, oil and a plasticizer can be used. It is possible to adjust the hardness of the rubber roller by the addition of the softening agent to the rubber composition. As the oil, it is possible to use mineral oil such as paraffin oil, naphthenic oil, aromatic oil; synthetic oil consisting of hydrocarbon oligomer; and process oil. As the synthetic oil, oligomer of α-olefin, oligomer of butane, and amorphous oligomer of ethylene and α-olefin. As the plasticizer, it is possible to use dioctyl phthalate (DOP), dibutyl phthalate (DBP), dioctyl sebacate (DOS), and dioctyl adipate (DOA).

Carbon black or the like can be used as the reinforcing agent to be contained in the rubber composition. The addition of the carbon black to the rubber composition improves the wear resistance of the paper-feeding roller. As the carbon black, it is possible to use HAF, MAF, FEF, GPF, SRF, SAF, MT, and FT. It is preferable that the diameter of the particle of the carbon black is not less than 10 μm nor more than 100 μm to disperse the carbon black favorably in the rubber composition.

The rubber composition is formed by using an ordinary method conventionally adopted. For example, necessary components such as rubber, a short fiber, a crosslinking agent are kneaded by using a known kneader such as an open roll, a Banbury mixer, and the like to obtain the rubber composition. The components are kneaded at 70° C. to 100° C. for about 3 to 10 minutes.

It is possible to adopt any methods of vulcanizing and molding the rubber composition, provided that they are capable of controlling the orientation of the short fiber. When the rubber composition is molded by using extrusion molding, the short fibers orient in parallel with an extrusion direction. In this case, the short fibers orient in almost parallel with the surface of a molded product. Therefore it is desirable to vulcanize and mold the rubber composition by using a method other than the extrusion molding. A transfer molding method is preferable for molding the rubber composition.

It is possible to simultaneously vulcanize the rubber composition and mold it tubularly by introducing it into a predetermined transfer molding die and heating it at 150° C. to 200° C. for 5 to 30 minutes. When the rubber composition is molded tubularly by using the transfer molding method, it is necessary to radially orient the short fibers contained in the rubber composition. The control of the orientation of the short fibers can be accomplished easily by adjusting the configuration of the molding die and the pressure when the rubber composition is introduced into the die.

Thereafter the obtained rubber tube is abraded with a cylindrical grinder until the rubber tube has a desired outer diameter. Then the rubber tube is cut to a desired length. Thereby the rubber roller is obtained. The short fibers contained in the obtained rubber roller are oriented at an angle not less than 10 degrees nor more than 90 degrees with respect to the plane which contacts the surface of the rubber roller. If the short fibers are oriented at an angle less than 10 degrees, it is difficult for the short fibers to obtain the action of sufficiently preventing the polymerization toner, the wax, and the like from attaching to the surface thereof. Therefore it is difficult for the short fibers to maintain the coefficient of friction of the surface of the paper-feeding roller favorably for a long time. Therefore the short fibers are oriented favorably at an angle not less than 10 degrees, more favorably at not less than 20 degrees, and most favorably at 90 degrees with respect to the plane which contacts the surface of the rubber roller.

When the short fibers are oriented at an angle not less than 10 degrees with respect to the plane which contacts the surface of the rubber roller, the coefficient of friction of the surface of the paper-feeding roller hardly deteriorates, even though the polymerization toner and the wax attach to the surface of the paper-feeding roller, because the short fibers have the action of scratching the surface of paper.

One end of each of the radially oriented short fibers is projected exposably from the surface of the rubber roller obtained after abrading the surface of the rubber tube. It is preferable that the number of short fibers whose one end is projected exposably from the surface of the rubber roller is not less than two nor more than 100 per 1 $mm^2$ of the surface of the rubber roller. If the number of the exposed short fibers is too small per 1 $mm^2$ of the surface of the rubber roller, it is impossible to obtain the effect of preventing the attachment of the polymerization toner, the wax, and the like to the surface of the rubber roller, even though the short fibers orient properly.

The examples of the present invention and the comparison examples will be described below.

Example 1

The following components were supplied to a closed type kneader: 100 parts by weight of ethylene-propylene-diene (EPDM) rubber, five parts by weight of silicon oxide, 10 parts by weight of calcium carbonate, one part by weight of carbon black, 0.5 parts by weight of stearic acid, three parts by weight of a crosslinking agent (1) consisting of peroxide, two parts by weight of a glass fiber serving as a short fiber. These components were kneaded to obtain a rubber composition.

The following substances were used as the above-described components.

EPDM: "Esprene 505A (commercial name)" produced by Sumitomo Kagaku Kogyo Inc.

Silicon oxide: "Nipsil VN3 (commercial name)" produced by Nippon Silica Kogyo Inc.

Calcium carbonate: "BF300 (commercial name)" produced by Bihoku Funka Kogyo Inc.

Titanium oxide: "Chronos titanium oxide KR380 (commercial name)" produced by Titanium Kogyo Inc.

Carbon black: "Sheast SO (commercial name)" produced by Tokai carbon Inc.

Stearic acid: "Tsubaki (commercial name)" produced by Nippon Yushi Inc.

Crosslinking agent (1) consisting of peroxide: "DCP (dicumyl peroxide) (commercial name)" produced by Nippon Yushi Inc.

Glass fiber (1): "Chopped strand BM33 (commercial name)" produced by NSG Vetrotex Inc. The average fiber diameter was 33 μm, and the average fiber length was 3 mm.

Glass fiber (2): "Chopped strand BM38 (commercial name)" produced by NSG Vetrotex Inc. The average fiber diameter was 11 μm, and the average fiber length was 3 mm.

Thereafter the obtained rubber composition was introduced into a transfer die to heat it at 160° C. for 20 minutes. Molding and vulcanization were performed simultaneously.

As a result, a rubber tube having an inner diameter of ø9 mm, an outer diameter of ø20 mm, and a length of 50 mm was obtained. Thereafter the obtained rubber tube was abraded with a cylindrical grinder until the outer diameter thereof became ø15 mm. Then the rubber tube was cut to a length of 24 mm. A core was inserted into the obtained rubber roller. Thereby the paper-feeding roller of the example 1 was obtained.

Examples 2 Through 11 and Comparison Examples 1 Through 3

Except that the components of the rubber composition of each of the examples 2 through 11 and comparison examples 1 through 3 were altered as shown in table 1, the paper-feeding rollers were prepared by carrying out a method similar to that used in the example 1.

In table 1, the unit of the numerical values showing the mixing amounts of the components is part by weight.

As each of the components shown in table 1 overlapping the component of the example 1, the substance having the same commercial name as that of the example 1 was used. The following substances were used as the components other than those used in the example 1.

Silicone rubber: "TSE221-5U (commercial name)" produced by GE Toshiba Silicone Inc.

Crosslinking agent (2) consisting of peroxide: "TC8 (commercial name)" produced by GE Toshiba Silicone Inc.

Carbon fiber: "Kureha Chop C106T (commercial name)" produced by Kureha Kagaku Kogyou Inc.

The average fiber diameter of the carbon fiber "Kureha Chop C106T" was 9 μm. The average fiber length thereof was 3 mm.

Evaluation

The following measurement and evaluation were made on the paper-feeding roller of each of the examples and the comparison examples prepared as described above. Table 1 shows the results.

TABLE 1

| | E1 | E2 | E3 | E4 | E5 | E6 | E7 |
|---|---|---|---|---|---|---|---|
| EPDM rubber | 100 | 100 | 100 | 100 | 100 | | |
| Silicone rubber | | | | | | 100 | 100 |
| Silicon oxide | 5 | 5 | 5 | 5 | 5 | | |
| Calcium carbonate | 10 | 10 | 10 | 10 | 10 | | |
| Titanium oxide | 10 | 10 | 10 | 10 | 10 | | |
| Carbon black | 1 | 1 | 1 | 1 | 1 | | |
| Stearic acid | 0.5 | 0.5 | 0.5 | 0.5 | 0.5 | | |
| Crosslinking agent consisting of peroxide(1) | 3 | 3 | 3 | 3 | 3 | | |
| Crosslinking agent consisting of peroxide(2) | | | | | | 0.5 | 0.5 |
| Carbon fiber(wt %) | | | | | 3 | | |
| Glass fiber 1(wt %) | 2 | 4 | 8 | 15 | | 4 | 12 |
| Glass fiber 2(wt %) | | | | | | | |
| Angle of fiber | 90 | 90 | 90 | 90 | 90 | 90 | 90 |
| Initial coefficient of friction | 1.2 | 1.1 | 1.1 | 1.0 | 1.1 | 0.9 | 0.9 |
| Situation of paper transport | ○ | ○ | ○ | ○ | ○ | ○ | ○ |
| Friction coefficient retention ratio(%) | 72 | 78 | 84 | 84 | 80 | 84 | 85 |

| | E8 | E9 | E10 | E11 | CE1 | CE2 | CE3 |
|---|---|---|---|---|---|---|---|
| EPDM rubber | 100 | 100 | | | 100 | | |
| Silicone rubber | | | 100 | 100 | | 100 | 100 |
| Silicon oxide | 5 | 5 | | | 5 | | |
| Calcium carbonate | 10 | 10 | | | 10 | | |
| Titanium oxide | 10 | 10 | | | 10 | | |
| Carbon black | 1 | 1 | | | 1 | | |
| Stearic acid | 0.5 | 0.5 | | | 0.5 | | |
| Crosslinking agent consisting of peroxide(1) | 3 | 3 | | | 3 | | |

TABLE 1-continued

| | | | | | | | |
|---|---|---|---|---|---|---|---|
| Crosslinking agent consisting of peroxide(2) | | | 0.5 | 0.5 | | 0.5 | 0.5 |
| Carbon fiber(wt %) | | | | | | | |
| Glass fiber 1(wt %) | | | 12 | 12 | | | 4 |
| Glass fiber 2(wt %) | 4 | 8 | | | | | |
| Angle of fiber | 90 | 90 | 45 | 10 | | | 0 |
| Initial coefficient of friction | 1.2 | 1.2 | 1.1 | 1.1 | 1.5 | 1.0 | 0.9 |
| Situation of paper transport | ○ | ○ | ○ | ○ | X | X | X |
| Friction coefficient retention ratio(%) | 68 | 76 | 80 | 68 | 50 | 58 | 62 |

where E denotes example and where CE denotes comparison example.

Orientation of Short Fiber

Figure 3:
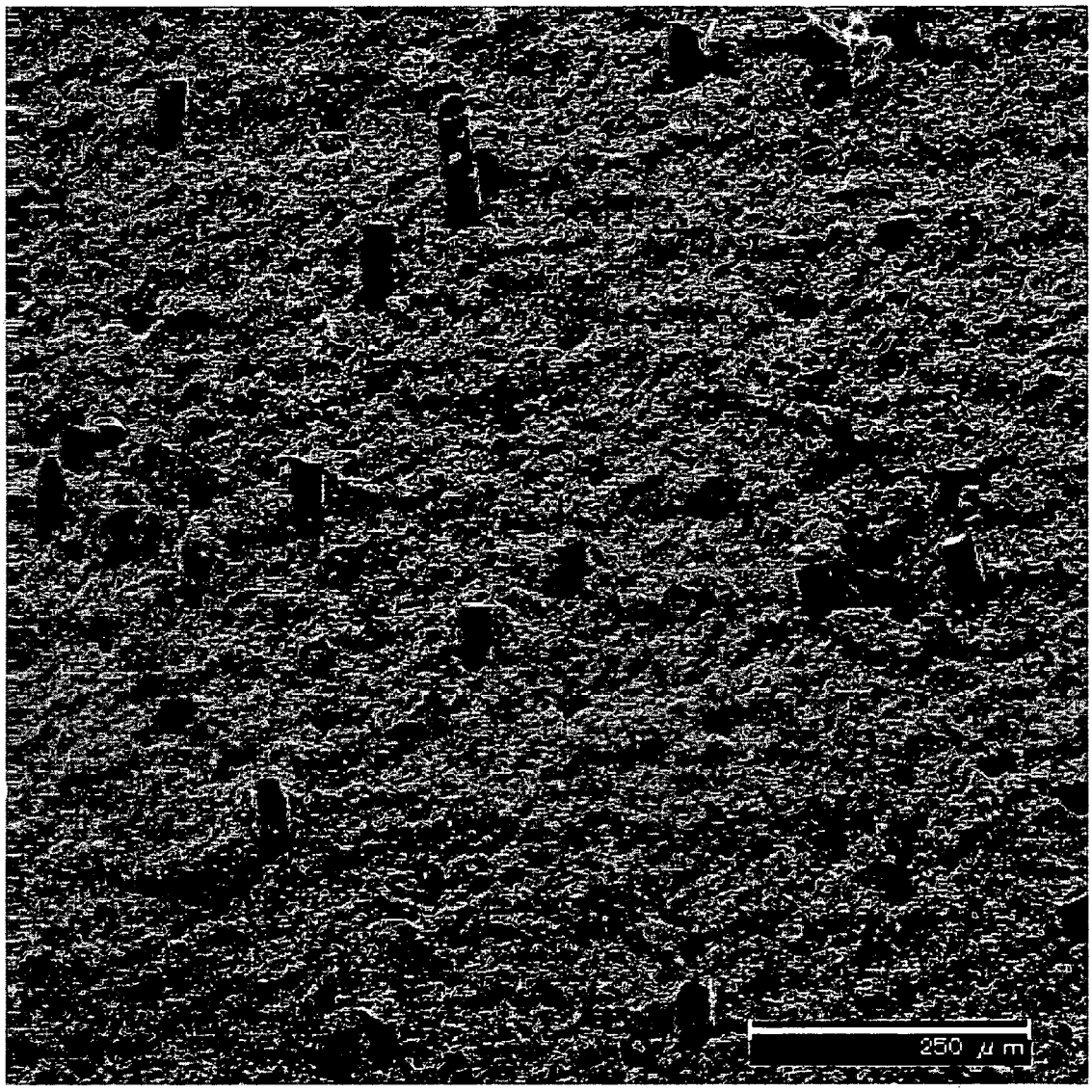
FIG. 3 shows a photograph of the surface of the rubber roller of an example 1 taken at a magnitude of 100.
Figure 4:
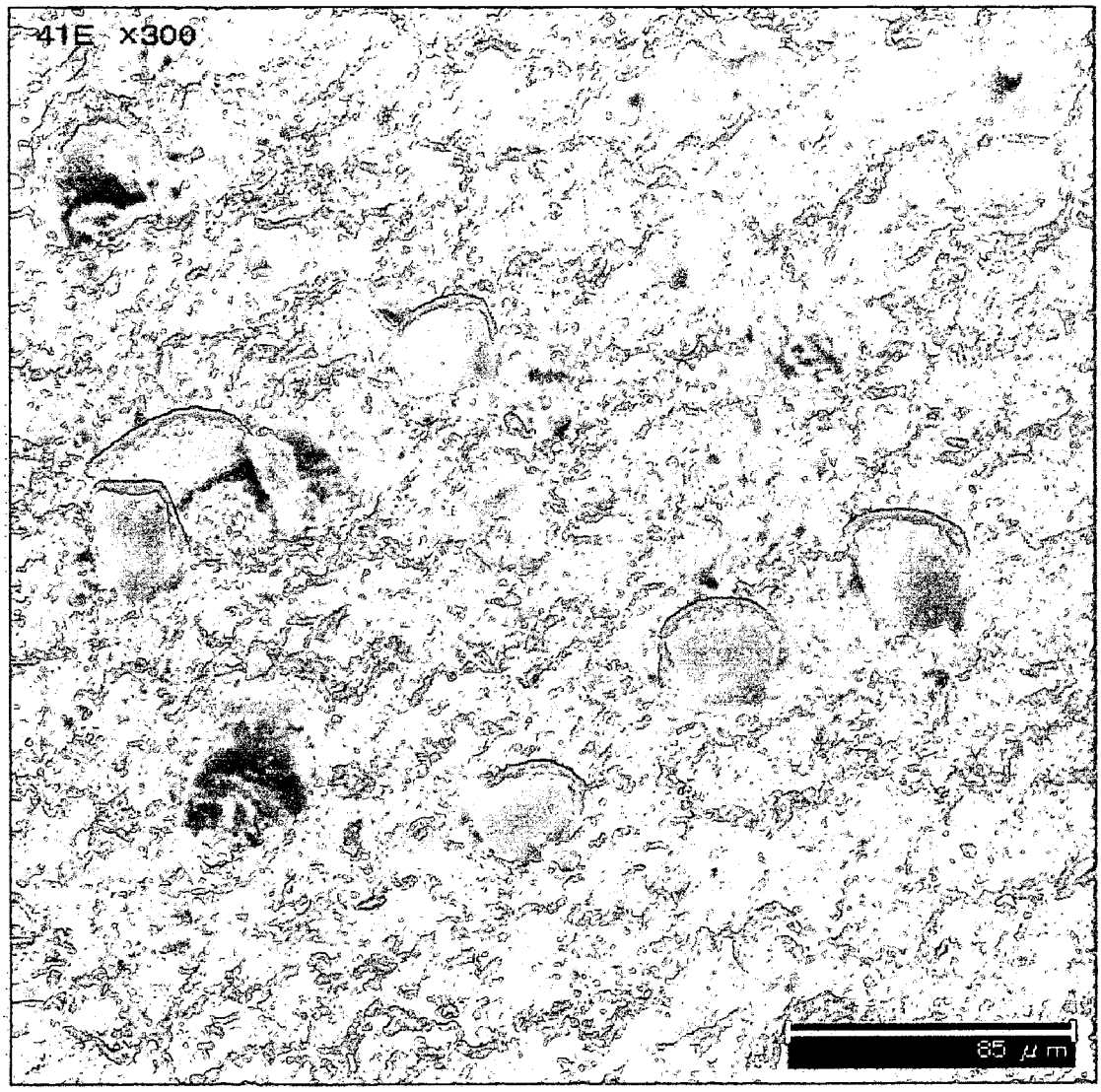
FIG. 4 shows a photograph of the surface of the rubber roller of the example 1 taken at a magnitude of 300.
Figure 5:
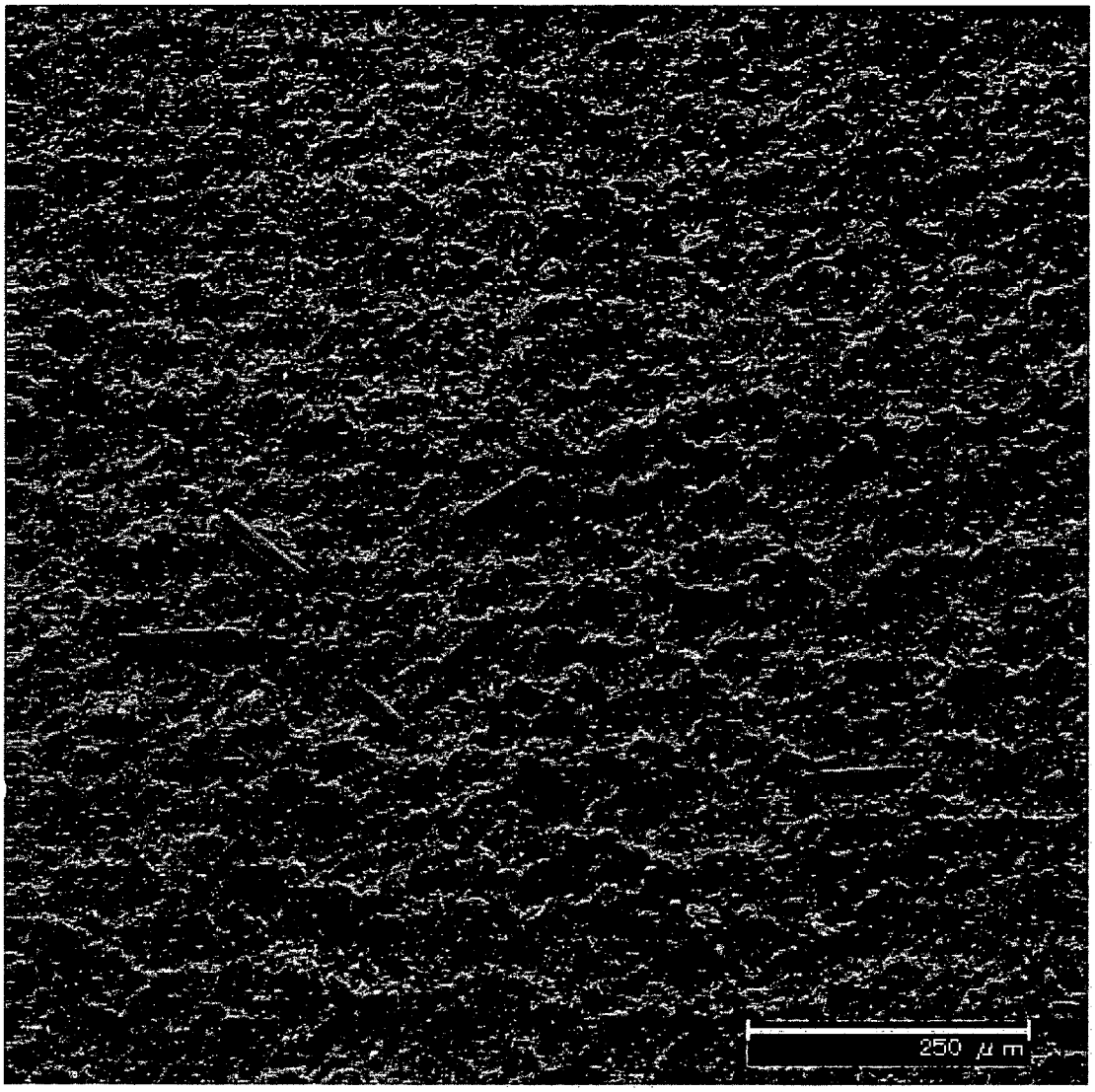
FIG. 5 shows a photograph of the surface of the rubber roller of the comparison example 3 taken at a magnitude of 100.

The surface and cross section of each rubber roller was photographed enlargedly to check the orientation of the short fiber. FIG. 3 shows a photograph of the surface of the rubber roller of the example 1 taken at a magnitude of 100. FIG. 4 shows a photograph of the surface of the rubber roller of the example 1 taken at a magnitude of 300. FIG. 5 shows a photograph of the surface of the rubber roller of the comparison example 3 taken at a magnitude of 100. The angle formed between the short fiber and a plane in contact with the surface of the rubber roller was computed.

Situation of Transport of Paper

Each paper-feeding roller was mounted on a printer "VIVACE455 (commercial name) manufactured by Fuji Zerox Inc. 1000 sheets of paper on which printing is performed by using the polymerization toner were supplied to the printer to observe whether the paper was transported favorably. As the paper 9, PB paper (commercial name) manufactured by Canon Inc. was used. The paper-feeding roller which transported the paper favorably was marked as ○. The paper-feeding roller which failed to transport the paper and the paper-feeding roller which transported a plurality of sheets of paper at a time were marked as X.

Friction of Coefficient

Figure 6:
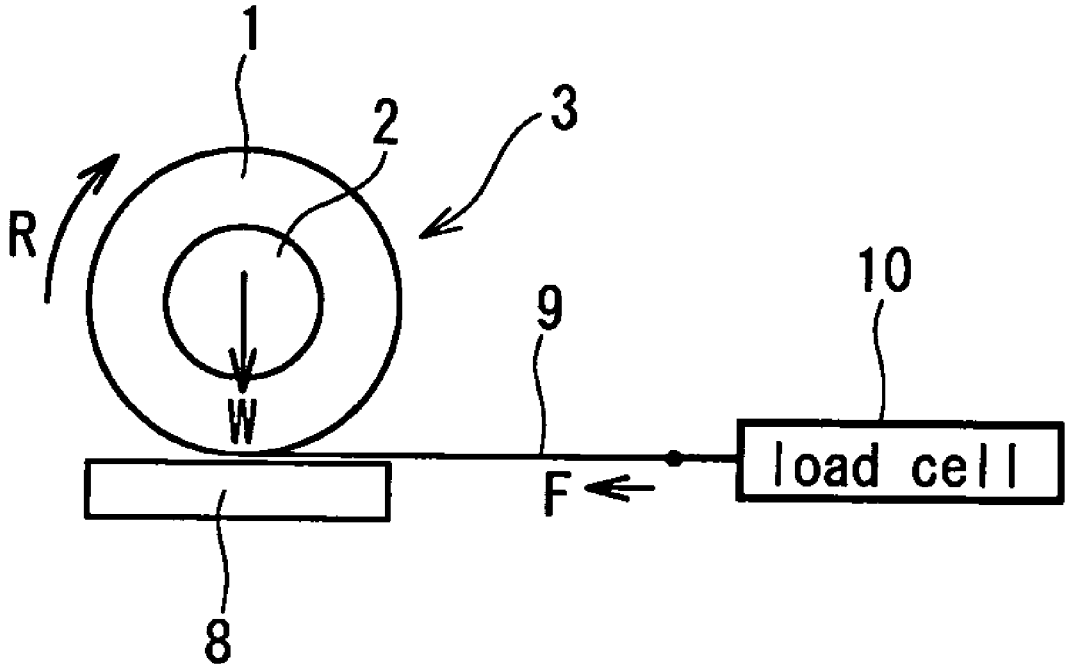
FIG. 6 shows the method of measuring the coefficient of friction of the paper-feeding roller.

The coefficient of friction of each paper-feeding roller was measured by using a method illustrated in FIG. 6. Initially one end of a sheet of the paper 9 having a size of 60 mmμm×210 mm was sandwiched between a paper-feeding roller 3 and a fixed plate 8 made of polytetrafluoroethylene (PTFE) with the other end of the paper 9 connected to a load cell 10. Thereafter a load W of 250 gf was applied to the plate 8 in the direction from the paper-feeding roller 3 toward the plate 8.

Thereafter the paper-feeding roller 3 was rotated at a peripheral speed of 300 mm/second in the direction shown with the arrow R in FIG. 6 at a temperature of 23° C. and a humidity of 55%. A transport force F applied to the load cell 10 at that time was measured. The coefficient of friction μ was computed from the transport force F and the load W (W=250 gf) by using an equation 1 shown below:

$$\mu = F(gf)/W(gf) \qquad \text{Equation 1}$$

An initial coefficient of friction μ0 and a coefficient of friction μ1000 at the time when the observation of the paper transport finished were computed. Table 1 shows the initial coefficient of friction μ0 and the friction coefficient retention ratio X computed at the time when the observation of the paper transport finished. The friction coefficient retention ratio X was computed by using an equation 2 shown below:

$$X(\%) = (\mu 1000/\mu 0) \times 100 \qquad \text{Equation 2}$$

Examination of Results

As shown in table 1, when the short fibers were formed at a certain angle with respect to the plane contacting the surface of the paper-feeding roller, the paper-feeding roller had a high initial coefficient of friction and transported the paper favorably. The friction coefficient retention ratio X of the paper-feeding roller of each of the examples was not less than 70%. The paper-feeding roller having a large amount of the short fiber had a little lower initial coefficient of friction, but had a sufficient coefficient of friction necessary for transporting paper. The paper-feeding roller having a large amount of the short fiber had a higher friction coefficient retention ratio.

The paper-feeding roller composed of the silicone rubber had a little lower initial coefficient of friction than the paper-feeding roller composed of the EPDM rubber, but had a higher friction coefficient retention ratio. The paper-feeding roller of each of the comparison examples 1 and 2 had a high coefficient of friction initially, but had a much lower friction coefficient retention ratio than the paper-feeding rollers of the examples.

The paper-feeding roller of the comparison example 3 containing the short fibers disposed in parallel with the surface of the surface thereof had a very low lower friction coefficient retention ratio. The paper-feeding roller of the comparison example 3 had a friction coefficient retention ratio almost equal to that of the paper-feeding roller of the comparison example 2 not containing the short fibers. The result indicates that to prevent the polymerization toner, the wax, and the like from attaching to the surface of the paper-feeding roller and maintain the coefficient of friction of the surface thereof favorably for a long time, it is very effective to orient the short fibers with respect to the plane contacting the surface of the paper-feeding roller.

The present invention has been developed to improve the reliability of the paper-feeding roller used to transport paper in paper-feeding mechanisms such as various types of printers, electrostatic copying machines, facsimile apparatuses, automatic teller machines (ATM) and the like. The paper-feeding roller of the present invention is particularly useful for the paper-feeding mechanism of a high-performance printer or the like in which the polymerization toner is used.

What is claimed is:

1. A paper-feeding rubber roller having a friction coefficient retention ratio from 68 to 85% and feeds 1000 sheets of paper on which printing is performed using a polymerization toner, said rubber roller being formed by a transfer molding method and is formed from a rubber composition containing 100 parts by weight of rubber and not less than 0.1 nor more than 20 parts by weight of short fibers per said amount of rubber, said rubber consisting of silicone rubber or ethylene-propylene-diene rubber and wherein said short fibers consist of carbon fibers or glass fibers, said short fibers having an average fiber diameter not less than 10 μm nor more than 100 μm and an average fiber length not less than 0.01 mm nor more than 4 mm; and at least one part of all of said short fibers being radially oriented at an angle not less than 10 degrees nor more than 90 degrees with respect to a plane which contacts a surface of said paper-feeding roller with one end of each of said radially oriented short fibers exposed on said surface of said paper-feeding roller, wherein the number of said short fibers having one end exposed on said surface of said paper-feeding roller is not less than five nor more than 100 per square millimeter of said surface of said rubber roller; and wherein said exposed short fibers project from said surface of said paper-feeding roller a distance of 5 μm to 150 μm.

2. An image-forming apparatus comprising a paper-feeding roller and a separation pad operatively associated with the roller, said roller having a friction coefficient retention ratio from 68 to 85% and feeds 1000 sheets of paper on which printing is performed using a polymerization toner, wherein the paper-feeding roller is formed by a transfer molding method and is formed from a rubber composition containing 100 parts by weight of rubber and not less than 0.1 nor more than 20 parts by weight of short fibers per said amount of rubber, said rubber consisting of silicone rubber or ethylene-propylene-diene rubber and wherein said short fibers consist of carbon fibers or glass fibers, said short fibers having an average fiber diameter not less than 10 μm nor more than 100 μm and an average fiber length not less than 0.01 mm nor more than 4 mm; and at least one part of all of said short fibers being radially oriented at an angle not less than 10 degrees nor more than 90 degrees with respect to a plane which contacts a surface of said paper-feeding roller with one end of each of said radially oriented short fibers exposed on said surface of said paper-feeding roller, wherein the number of said short fibers having one end exposed on said surface of said paper-feeding roller is not less than five nor more than 100 per square millimeter of said surface of said rubber roller; and wherein said exposed short fibers project from said surface of said paper-feeding roller a distance of 5 μm to 150 μm.

3. The image-forming apparatus according to claim 2, wherein said paper-feeding roller is used as a paper-feeding roller, a resist roller, or a transfer roller.

4. The paper-feeding roller according to claim 1, wherein the roller has a cylindrical shape and is formed entirely of the rubber composition containing said short fibers.

* * * * *